United States Patent [19]

Matsumoto

[11] Patent Number: 4,566,815

[45] Date of Patent: Jan. 28, 1986

[54] STRUCTURE FOR MOUNTING ROLLER ON SHAFT

[75] Inventor: Hiroshi Matsumoto, Tokyo, Japan

[73] Assignee: Seikosha Co., Ltd., Tokyo, Japan

[21] Appl. No.: 553,181

[22] Filed: Nov. 18, 1983

[30] Foreign Application Priority Data

Nov. 19, 1982 [JP] Japan ..... 57-175146

[51] Int. Cl.[4] ..... B41J 13/02

[52] U.S. Cl. ..... 400/641; 400/639.1; 403/289; 403/290; 29/116 R

[58] Field of Search ..... 400/616.3, 636, 637, 400/638, 639, 639.1, 641, 636.2; 29/110, 116 R; 403/289, 290, 309, 310, 313, 344, 377, 381; 474/903

[56] References Cited

U.S. PATENT DOCUMENTS

| | | | |
|---|---|---|---|
| 2,113,579 | 4/1938 | Dybvig | 400/616.3 |
| 2,356,842 | 8/1944 | Helmond | 400/641 |
| 2,625,415 | 1/1953 | Smith | 400/289 |
| 2,891,301 | 6/1959 | Conklin | 29/116 R |
| 3,519,117 | 7/1970 | Smith | 400/636.2 |
| 3,565,470 | 2/1971 | Nicol et al. | 400/290 |

*Primary Examiner*—Ernest T. Wright, Jr.

*Attorney, Agent, or Firm*—Robert E. Burns; Emmanuel J. Lobato; Bruce L. Adams

[57] ABSTRACT

A structure having a shaft and a paper retaining roller mounted on the shaft for use in a printer. The structure further includes a retaining element mounted on the shaft so as to be opposed to the roller for retaining the roller in a given axial position on the shaft. The roller is rotatable about the shaft and has a flange at its one end. The retaining element has a plurality of resilient retaining arms and its one end to hold the flange rotatably. At the opposite end, the retaining element is also provided with a plurality of resilient arms which are in frictional engagement with the outer periphery of the shaft. The roller can be slid axially along the shaft when a force greater than a given magnitude is applied thereto.

10 Claims, 3 Drawing Figures

STRUCTURE FOR MOUNTING ROLLER ON SHAFT

FIELD OF THE INVENTION

The present invention relates to a structure for mounting a roller on a shaft and, more particularly, to a structure for mounting a roller on a shaft such that the roller is rotatable about the shaft and that the roller can be slid axially along the shaft upon application thereto of a force greater than a predetermined magnitude.

BACKGROUND OF THE INVENTION

In some printers, a roller for retaining paper is mounted such that it is rotatable about a shaft and that it can be slid axially when subjected to a force greater than a given magnitude. The roller is shifted in the axial direction according to the width of the paper. A known structure for effecting such an operation is shown in FIG. 3, in which a roller b is centrally provided with a hole c so as to be loosely and rotatably inserted on a shaft a. A guide groove d is formed in the inner surface of the hole c, and a ring spring e shaped like the letter "C" is inserted in the groove d. The spring e is resiliently urged against the outer periphery of the shaft a. The roller b can be rotated at that axial position about the shaft a while guided by the spring e. The roller b can be slid axially by pushing it with a force greater than the retaining force exerted by the spring e on the shaft a. In this conventional structure, it is difficult to insert the ring spring e in the guide groove d during assembly of the structure. Further, it is difficult to form the roller b by injection molding because of the presence of the groove d. Accordingly, the groove d is formed by machining and hence the structure is manufactured and assembled quite inefficiently.

SUMMARY OF THE INVENTION

Accordingly, it is a main object of the present invention to provide a structure which mounts a roller on a shaft such that the roller is rotatable about the shaft and that the roller can be slid axially by applying thereto a force greater than a given magnitude, and which is assembled more efficiently and more economically than the conventional structures.

Other objects and features of the invention will become apparent from a reading of the description of the invention which follows.

DETAILED DESCRIPTION OF THE INVENTION

Figure 1:
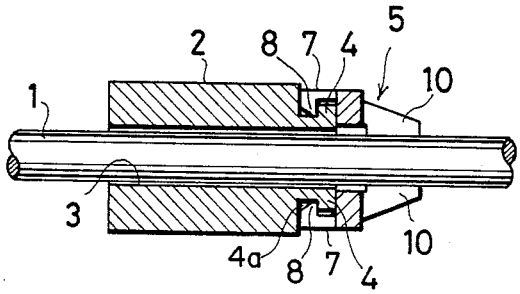
FIG. 1 is a cross-sectional view of a structure according to the present invention.
Figure 2:
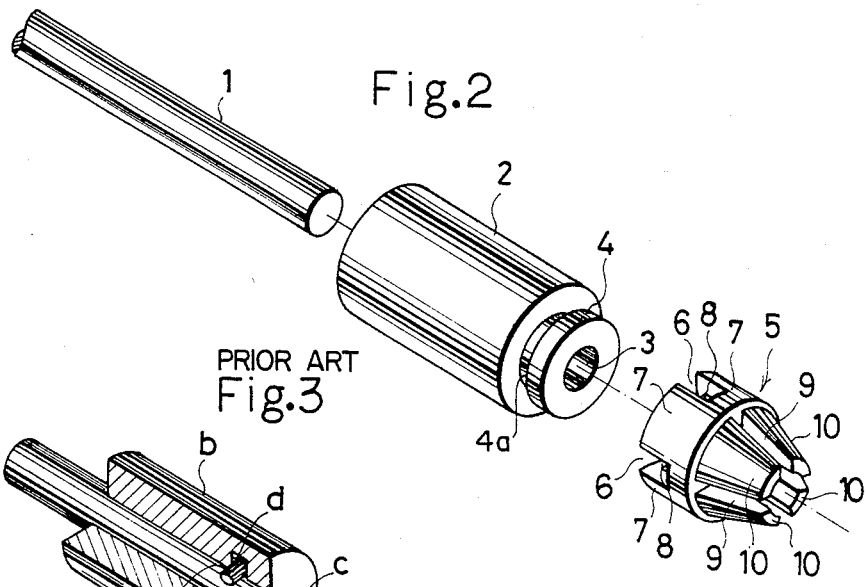
FIG. 2 is an enlarged and exploded perspective view of the structure of FIG. 1.
Figure 3:
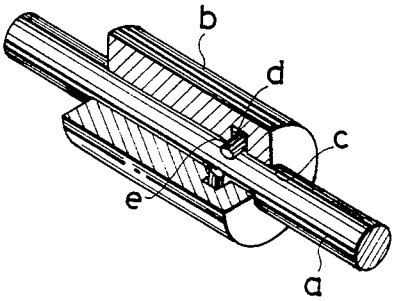
PRIOR ART Fig.3
FIG. 3 is a perspective view partially in section of a conventional structure.

Referring to FIGS. 1 and 2, there is shown a structure embodying the concept of the present invention. In this structure, a roller 2 is centrally provided with a lengthwise hole 3 such that the roller 2 is rotatably fitted over a shaft 1. At one end, the roller 2 has an annular groove 4*a* defined by a flange 4 whose diameter is smaller than that of the other major portion of the roller 2. A retaining element 5 is mounted on the shaft 1 so as to be opposed to the roller 2. The element 5 has a plurality of elastic retaining arms 7 which are circumferentially spaced by slits 6. Each of the arms 7 has a claw or projection 8 protruding inwardly from its front, inner surface at the distal end thereof. Formed at the opposite end of the retaining element 5 are a plurality of resilient arms 10 for resiliently mounting the retaining element on the shaft 1, the arms 10 being circumferentially spaced by slits 9.

As shown in FIG. 2, when the retaining element 5 is pressed into the flange 4 of the roller 2 from the right side, the flange 4 abuts on the inner surfaces of the retaining arms 7 of the element 5. The claws or projections 8 slidably engage in the groove 4*a* and prevent disengagement of the flange 4 from the element 5 thereby connecting the roller 2 and the element 5. Hence, the flange 4 is rotatably held by the resilient retaining arms 7 so that the roller 2 can undergo rotation or angular displacement relative to both the shaft 1 and the element 5. Then, the shaft 1 is inserted in the roller 2, whereby the condition shown in FIG. 1 is attained. Under this condition, the inner peripheries of the resilient arms 10 of the element 5 are resiliently attached to the outer periphery of the shaft 1, and the element 5 is brought into frictional engagement with the shaft 1 by the resilience of the arms 10. Therefore, unless a force greater than the frictional force of the arms 10 is applied, the roller 2 is held at that given axial position on the shaft 1 and is rotatable or angularly displaceable about the shaft 1. The roller 2 can be moved or displaced in the axial direction of the shaft 1 by pushing the roller 2 or the element 5 with a force exceeding the frictional force produced by the arms 10.

As described hereinbefore, the novel structure can be assembled very rapidly and easily. Further, the roller 2 and the retaining element 5 can be manufactured as integral one-piece structures by plastic molding and machining. Thus, the structure can be manufactured economically.

It is to be understood that the invention is not limited in its application to the details of construction and arrangement of parts illustrated in the accompanying drawing, since the invention is capable of other embodiments and of being practiced or carried out in various ways. Also it is to be understood that the phraseology or terminology employed herein is for the purpose of description and not of limitation.

What is claimed is:

1. A structure for mounting a roller on a shaft, comprising:
   - a shaft,
   - a roller mounted on the shaft, and
   - a retaining element mounted on the shaft so as to be opposed to the roller for retaining the roller in a given axial position on the shaft,
   - the roller being loosely mounted on the shaft so as to be rotatable thereon, the roller having a flange at one end thereof,
   - the retaining element having a plurality of resilient retaining arms at one end thereof to retain the flange rotatably, the retaining element also having a plurality of resilient arms at the other end thereof, the latter resilient arms being in frictional engagement with the outer periphery of the shaft.

2. A structure as set forth in claim 1, wherein the retaining element has a plurality of claws engageable with the flange to prevent disengagement of the flange from the retaining element.

3. A stucture as set forth in claim 1, wherein the roller and the retaining element comprise molded plastic pieces.

4. A structure for mounting a roller on a shaft comprising: a shaft, a roller loosely mounted on the shaft to undergo angular displacement thereabout and axial displacement therealong; and retaining means connected to the roller for retaining the roller in a given axial position on the shaft while permitting angular displacement of the roller about the shaft, the retaining means including a plurality of circumferentially spaced-apart resilient arms extending axially along and in frictional engagement with the shaft, the resilient arms exerting a predetermined frictional force on the shaft sufficient to maintain the roller in the given axial position on the shaft and enabling axial displacement of the roller along the shaft when a force exceeding the predetermined frictional force is applied to the roller.

5. A structure for mounting a roller on a shaft according to claim 4; wherein the retaining means includes means releasably connected to cooperating means on the roller for permitting angular displacement of the roller about the shaft relative to both the shaft and the retaining means.

6. A structure for mounting a roller on a shaft according to claim 5; wherein the cooperating means on the roller comprises means defining an annular groove at one axial end of the roller, and the retaining means includes another plurality of circumferentially spaced-apart resilient arms extending axially toward the roller one end, the another plurality of resilient arms having at their distal ends inwardly extending projections which slidably engage in the roller annular groove to permit angular displacement but not axial displacement of the roller relative to the retaining means.

7. A structure for mounting a roller on a shaft according to claim 6; wherein the retaining means comprises an integral one-piece structure.

8. A structure for mounting a roller on a shaft according to claim 6; wherein the retaining means comprises a molded plastic integral one-piece structure.

9. A structure for mounting a roller on a shaft according to claim 4; wherein the retaining means comprises an integral one-piece structure.

10. A structure for mounting a roller on a shaft according to claim 4; wherein the retaining means comprises a molded plastic integral one-piece structure.

* * * * *